United States Patent [19]

Sember et al.

[11] Patent Number: 4,597,723

[45] Date of Patent: Jul. 1, 1986

[54] LOW PRESSURE AIR SUPPLY AND CONTROL SYSTEM

[76] Inventors: Joseph A. Sember, Jasco Products, Inc., P.O. Box 10236, Glendale, Calif. 91209; Joseph A. Sember, III, 4330 Berkshire Ct., Oxnard, Calif. 93030

[21] Appl. No.: 385,611

[22] Filed: Jun. 7, 1982

[51] Int. Cl.[4] ..... F04B 21/00; F04B 39/10; F16K 15/14

[52] U.S. Cl. ..... 417/440; 417/566; 137/883

[58] Field of Search ..... 417/566, 413, 440; 137/883

[56] References Cited

U.S. PATENT DOCUMENTS

| | | | |
|---|---|---|---|
| 2,253,206 | 8/1941 | Farrow, Jr. et al. | 417/566 |
| 2,832,373 | 4/1958 | Scholor | 137/881 |
| 2,986,098 | 5/1961 | Trout et al. | 417/566 |
| 3,147,767 | 9/1964 | Goss | 137/883 |
| 3,174,507 | 3/1965 | Matts et al. | 137/883 |
| 3,499,464 | 3/1970 | Williams et al. | 137/883 |
| 3,552,436 | 1/1971 | Stewart | 137/883 |
| 3,671,151 | 6/1972 | Duke et al. | 137/883 |
| 4,078,728 | 3/1978 | Nordoon | 137/881 |
| 4,086,036 | 4/1978 | Hagen | 417/566 |
| 4,491,157 | 1/1985 | Hastimoto | 137/881 |

*Primary Examiner*—William L. Freeh

[57] ABSTRACT

The invention concerns the combination of electric motor, diaphragm air pump, valving and switches in a compact form to provide a low pressure air supply and control system for use in inflating and/or deflating air chambers in seats. The air chambers may be so placed as to provide support to areas of the back of an occupant, support to the occupant's thighs, either singly or both at the same inflation/deflation and/or movement of the side bolsters of the seat. Additionally, it may be used to inflate/deflate the seat bottom.

3 Claims, 4 Drawing Figures

FIG. 3
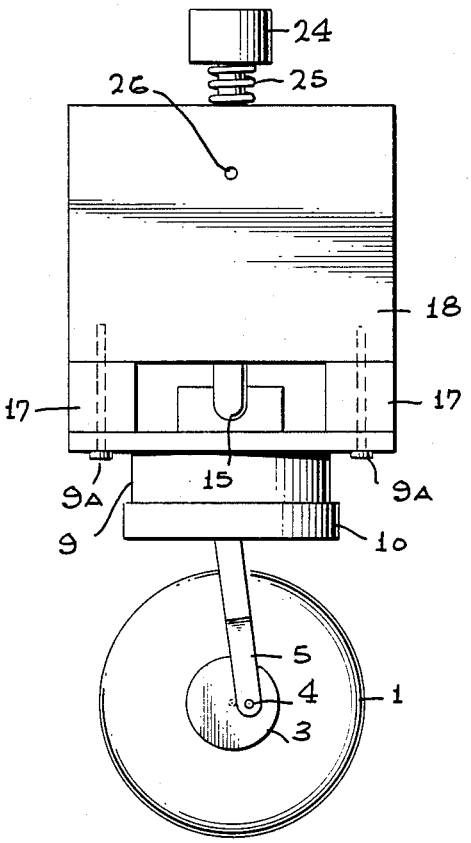
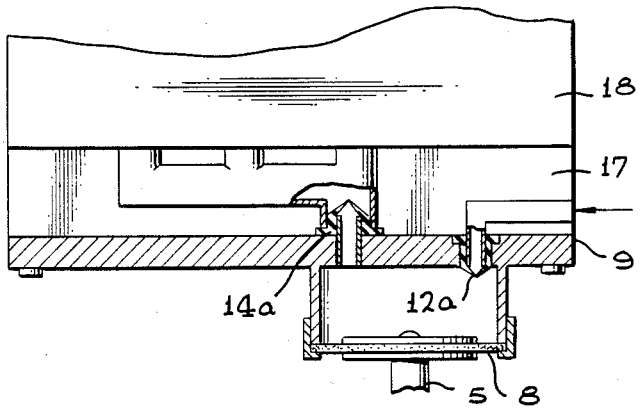
FIG. 4

LOW PRESSURE AIR SUPPLY AND CONTROL SYSTEM

BACKGROUND OF THE INVENTION

Various types of inflatable seat and cushion constructions are well known and are intended to provide comfortable support for various sections of the body such as the lower back section. The compartments in these seat cushions must periodically be inflated or reinflated to retain the degree of support required by the seat occupant. An inexpensive pump and valve control system for supplying inflating air at relatively low pressure to seat cushions and the like is therefore desired.

BRIEF SUMMARY OF THE INVENTION

The present invention provides a low pressure air supply and control system for inflating seat cushions and the like which draws power from the rotary output shaft of a conventional electric motor and converts it to a linear reciprocating motion. A variable volume pumping chamber having a reciprocating diaphragm controlled by the output of the electric motor receives inlet air and discharges it past suitable one way valves to an outlet passageway which is connectable with the seat or cushion to be inflated. A relatively simple arrangement for depressurizing the seats is also provided and is conveniently arranged in the pump discharge chamber.

DETAILED DESCRIPTION

For a complete understanding of my invention, reference is to be had to the following description and accompanying drawings in which:

FIG. 3 is an end view showing assembly of the system; and

FIG. 4 is a partial view showing an alternate valving arrangement.

Figure 1:
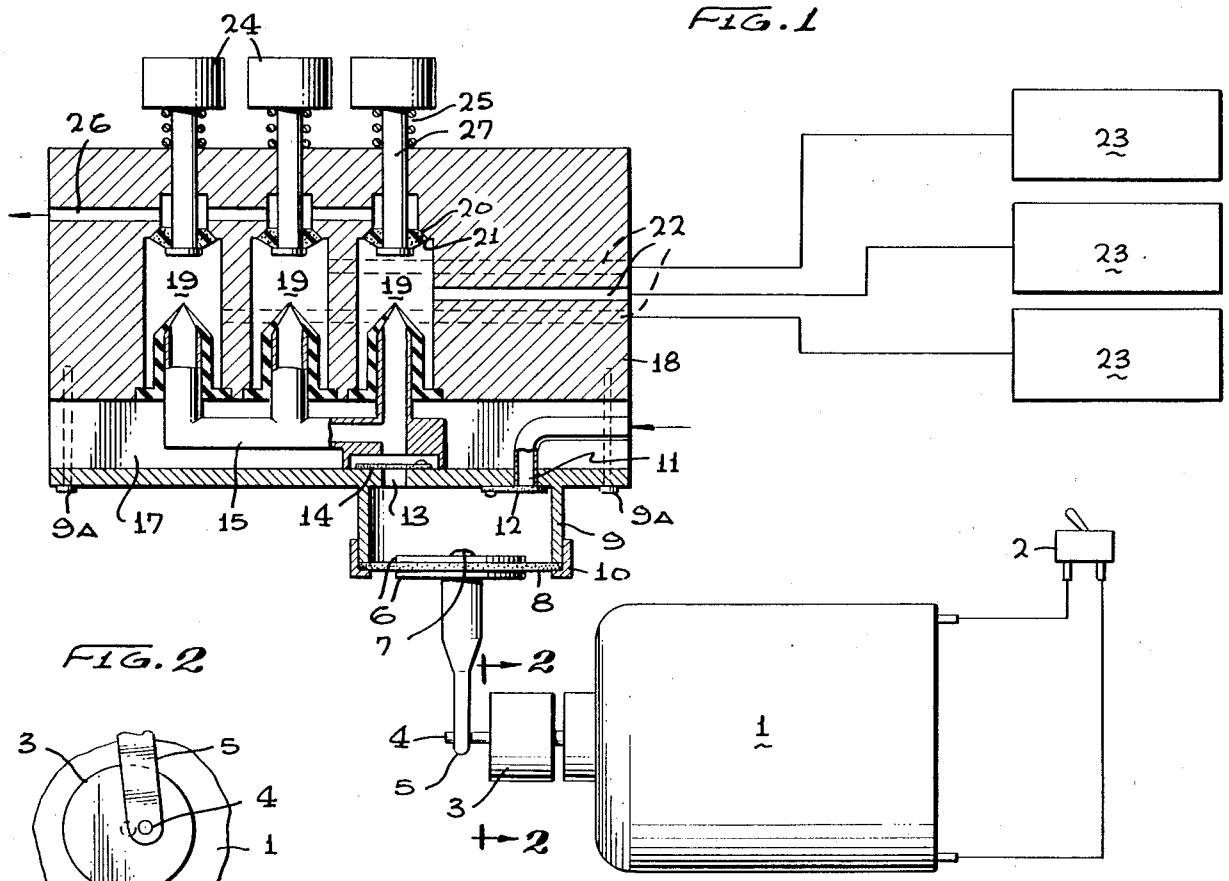
FIG. 1 is a plan view, partly in section, of a presently preferred embodiment of an air pressure supply and control system.
Figure 2:
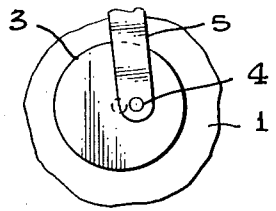
FIG. 2 is a partial end view taken along lines 2—2 in FIG. 1.

With reference to FIG. 1, an electric motor 1 of either AC or DC current input, is controlled by switch 2. Affixed to the rotatable shaft of the motor is a cylindrical element 3 central to the shaft. Offset from the center of this cylinder is affixed a smaller cylindrical eccentric shaft 4 as best seen in FIG. 2. As the motor shaft is caused to rotate when switch 2 is depressed to allow electric power to the motor, the eccentric shaft 4 travels in a circular orbit around the extended center line of the motor shaft. The eccentric shaft 4 engages a hole in plunger 5 affixed by washers 6 and screw 7 to clamp a flat or convoluted diaphragm 8. Diaphragm 8 is clamped along its outer periphery to the open end of a diaphragm valve block 9 having a variable volume pumping chamber therein by cap 10. This clamping effects an air tight seal at the interface of the diaphragm 8 and the diaphragm valve block 9.

As seen in FIG. 3 the air supply and control system generally comprises a diaphragm valve block 9 affixed by screws 9*a* to a control valve block 18. Two communicating blocks 17 act as spacers between the diaphragm valve block 9 and control valve block 18 to provide clearance space for a purpose to be described.

An input valve port 11 is fashioned in the diaphragm valve block 9 over which a one way valve in the form of a flexible flapper plate 12 is affixed. An output valve port 13 is fashioned in the diaphragm valve block 9 over which a second one way valve in the form of a flexible flapper plate 14 is affixed. The ports 11, 13 respectively admit and discharge fluid from the variable volume pumping chamber.

Rotation of the electric motor shaft causes the plunger 5 to reciprocate the diaphragm 8 to vary the volume of the pumping chamber so that as the diaphragm 8 is caused to move outward from the valve block, flapper 14 is closed against port 13 and flapper 12 is caused to move away from the port 11 thereby allowing the outside air to flow into the variable volume pumping chamber as its volume expands by the outward movement of diaphragm 8. Further rotation of the electric motor shaft then causes plunger 5 to reverse the direction of movement of diaphragm 8 to decrease the volume in the pumping chamber. As the volume begins to decrease, the increasing air pressure causes flapper 12 to close over port 11 and causes flapper 14 to open port 13. The air is then caused to move through outlet passage 15 to the inlet end of one or more one way duck bill type elastomeric valve 16. Integral flanges of the elastomeric valves are clamped between communicating block 17 and control valve block 18 to effect an air tight seal. The duck bill type valves 16 are caused to allow passage of air into the control valve block, when the air pressure is greater at its open end than at the outside of the duck bill end. Air passing through the duckbill moves into discharge chambers 19 and is then caused to move through passageways 22 to air tight bladders/-cushions 23 and then to inflate these bladders/cushions. When sufficiently inflated, the current to the motor is switched off thereby stopping further inflation.

A depressurization valve is formed by a valve seal 20 affixed to the end of shaft 27 mounted in control valve block 18. Valve seal 20 mates with seat 21 to selectively block fluid flow from discharge chamber 19 to exhaust passage 26.

When one or more of the bladders/cushions is to be decreased in volume content, a corresponding valve button 24 at the end of shaft 27 is depressed with enough force to overcome force of closing spring 25 and any internal air pressure force so as to unseat the valve seal 20. The air in the bladder/cushion is then allowed to move past the seal 20 to exhaust passage 26. When the operator releases the depressing force on the valve button, the spring around the button shaft 27 pushes seal 20 back against its seat 21 and traps the remaining air in the bladder/cushion.

FIG. 4 shows an alternative valving arrangement wherein, in diaphragm valve block 9, one way duck bill valves 12*a*, 14*a* can be substituted in place of flapper valves 12, 14. Integral flanges on the duck bill valves 12*a*, 14*a* are clamped between the diaphragm valve block 9 and the input port 11 and the outlet passage 15.

Rotation of the electric motor shaft causes the plunger 5 to reciprocate the diaphragm 8 to vary the volume of the pumping chamber so that as the diaphragm 8 is caused to move outward from the valve block, the higher air pressure on the ouside of duck bill 14*a* keeps it closed and the lower than atmospheric pressure on the inside of duck bill 12*a* causes air to force open the duck bill lips of 12*a*, allowing air into the increasing chamber volume. As the volume begins to decrease in the pumping chamber, the increasing air pressure causes the duckbill 12*a* lips to seal closed and causes the duck bill 14*a* lips to open so as to allow air flow into the system.

The low pressure air supply disclosed herein utilizes the compressibility characteristics of air whereby the stretch of the elastomeric diaphragm and its total reciprocating stroke is designed so as to generate a predictable pressure in the system thereby providing a self-limiting pressure output capability of the pump. When the pressure in the total system reaches the maximum level attained by the volume change in the pumping chamber as governed by the laws of Boyle and Charles, i.e., PV=RMT, and by the stretch of the diaphragm during the compression stroke, a state of equilibrium is achieved. This eliminates the need for over-pressure protection downstream of the pump; also, the motor may be sized to allow continous running without stalling or overheating.

The system described herein is applicable to all transportation seating, to hospital seats, beds, operating tables and wheel chairs, and, to stationary seating cushions.

We claim:

1. A low pressure air supply and control system comprising:

(a) a motor having a rotary output shaft;

(b) means for converting rotary motion of said output shaft to linear reciprocating motion; and (c) an air pump having (1) a variable volume pumping chanber having a reciprocating wall connected to said means for converting rotary motion to reciprocating motion;

(2) an input port in fluid communication with said pumping chamber;

(3) a one way valve permitting fluid flow from said input port into said pumping chamber;

(4) an outlet passage in a fluid communication with said pumping chamber;

(5) a one way valve means permitting fluid flow out of said pumping chamber through said outlet passage;

(6) a discharge chamber in fluid communication with said outlet passage, said discharge chamber having a discharge passage in fluid communication therewith;

(7) an exhaust passage in fluid communication with said discharge chamber; and (8) a depressurization valve normally biased into closed position selectively connecting said discharge chamber to said exhaust passage; said one way valve means permitting fluid flow through said outlet passage comprising a duckbill elastomeric valve affixed to a discharge end of said outlet passage located in said discharge chamber.

2. A low presure air supply according to claim 1 wherein said one way valve means permitting fluid flow through said outlet passage further comprises a one way flapper plate permitting fluid flow from said pumping chamber into said outlet passage.

3. A low pressure air supply according to claim 1, wherein said depressurization valve comprises a valve seal and a valve seat located in said discharge chamber, said seal being spring biased into engagement with said valve seat to block fluid flow from said discharge chamber to said exhaust passage.

* * * * *